US005250145A

United States Patent [19]

Despins et al.

[11] Patent Number: 5,250,145

[45] Date of Patent: Oct. 5, 1993

[54] APPLICATOR TIP FOR DISPENSING LIQUID ADHESIVE TO SEAM ADJACENT LAYERS OF FLOORCOVERING SHEETING

[76] Inventors: Maurice L. Despins, 11203 - 105 Street, Edmonton, Alberta, Canada, T5G 2M4; William H. Carveth, 8118 Rowland Road, Edmonton, Alberta, Canada

[21] Appl. No.: 758,598

[22] Filed: Sep. 12, 1991

[51] Int. Cl.[5] ..... B65C 11/04

[52] U.S. Cl. ..... 156/578; 156/304.1; 156/304.7; 156/546; 156/579; 156/71

[58] Field of Search ..... 156/578, 579, 304.1, 156/304.7, 304.4, 71, 544, 546

[56] References Cited

U.S. PATENT DOCUMENTS

| | | | |
|---|---|---|---|
| 2,307,280 | 1/1943 | Krasno | 156/578 X |
| 4,484,976 | 11/1984 | Despins | 156/578 |
| 4,613,396 | 9/1986 | Scarborough | 156/579 X |
| 4,729,810 | 3/1988 | Brooks | 156/579 X |

*Primary Examiner*—Jeff H. Aftergut
*Attorney, Agent, or Firm*—Sheridan Ross & McIntosh

[57] ABSTRACT

The applicator tip is used by inserting it between the side edges of the adjacent layers of floorcovering sheeting which are to be seamed. The tip is pulled along the line of abutment and wets the side edges with liquid adhesive. The tip comprises an upright body having a bottom foot portion having wedges for upraising and tilting marginal portions of the floorcovering as they pass therebeneath, an intermediate ankle portion that is relatively narrow, and an upper leg portion adapted to connect with a squeeze bottle containing the adhesive. A flow passageway extends through the leg portion and into the ankle portion and has side-opening outlets in the side surfaces of the ankle portion. Thus the adhesive is discharged laterally relative to the seam. Means are provided to press against the top surface of the upraised marginal portions to guide the side edges into close engagement with the outlets.

16 Claims, 8 Drawing Sheets

APPLICATOR TIP FOR DISPENSING LIQUID ADHESIVE TO SEAM ADJACENT LAYERS OF FLOORCOVERING SHEETING

FIELD OF THE INVENTION

This invention relates to an applicator tip for use in seaming linearly abutting, side-by-side, planar layers of floorcovering with liquid adhesive, to form a finished seam extending along the line of abutment.

DEFINITIONS

For purposes of this specification, "floorcovering" is intended to encompass both carpet and resilient flooring material. "Open seam" is intended to describe the gap formed between the vertical side edges of abutting layers of floorcovering, which gap appears when the marginal floorcovering portions adjacent the side edges are simultaneously raised by the tip passing thereunder. "Closed seam" is intended to describe the linear break between the abutting planar layers of floorcovering when they are lying flat on the sub-floor or underlay, with the side edges not yet bonded by adhesive. And "finished seam" is intended to describe the seam after applied adhesive has bonded the side edges.

BACKGROUND OF THE INVENTION

As a beginning point, it is useful to shortly describe the various forms of what is known in the industry as "resilient flooring" and to provide some background on the seaming techniques used in the past with that material. Resilient flooring is generic to:

linoleum;

rigid-backed vinyl (such as the material sold under the well known trade-mark CORLON);

cushion backed vinyl; and homogeneous vinyl (which is a solid layer of vinyl).

Linoleum was commonly seamed by laying the vertical side edges of adjacent layers in close abutment, folding back the adjacent marginal portions of the floorcovering layers to expose the sub-floor, applying a band of water-resistant adhesive to the sub-floor along the line of abutment using a spatula-like tool called a 'spreader', then bringing the marginal portions back down onto the sub-floor, and hand-rolling the seam to complete the operation.

The rigid-backed vinyl was seamed in the same fashion as the linoleum, except that an excess of the sub-floor adhesive was applied to the sub-floor along the line of abutment, with the hope that it would squeeze up between the abutting side edges when they were pressed down, to seal and bond them together.

In the case of the cushion-backed vinyl, the marginal portions were first laid flat on the adhesive-coated sub-floor, in the same manner as linoleum. An applicator was then used to apply low viscosity, solvent-base, liquid adhesive into the closed seam. The applicator comprised a plastic squeeze bottle having a hollow, knife blade-like tip. The cushion-backed vinyl could be laterally compressed slightly, to allow penetration of the tip for application of the liquid adhesive.

In the case of the homogeneous vinyl, a narrow groove would be cut along the seam, a bead of vinyl would be laid into the groove and a hot iron would be used to melt the bead and adjacent material to thereby weld the side edges together.

From the foregoing, it will be understood that seaming involved bonding the undersurface of the floorcovering to the sub-floor with pre-applied thick adhesive and bonding the vertical side surfaces together, either by application of low viscosity, liquid adhesive or by heat welding the vinyl edges.

In the mid-eighties one of the present applicants developed a novel applicator tip for use with homogeneous vinyl. The tip was disclosed in U.S. Pat. No. 4,484,976, issued Nov. 27, 1985, and is hereafter referred to as the "prior tip".

This prior tip was designed to wet the vertical side edges of the floorcovering with a solvent-base liquid adhesive. The tip is adapted to raise the flat marginal portions of the floorcovering as it passes along the seam, thereby exposing the vertical side edges while wetting them with liquid adhesive. More particularly, the installer inserts the tip between the floorcovering side edges and beneath the adjacent marginal portions. He then pulls the tip along the seam. The tip is connected at its upper end to a plastic squeeze bottle containing a supply of liquid adhesive. The tip forms a longitudinal passageway having an outlet positioned to deliver the adhesive to the faces of the floorcovering side edges. The bottle is manually squeezed by the installer as he draws the assembly along the line of abutment, to discharge the adhesive.

Structurally, the prior tip comprises:

An upstanding, body having, from top to bottom, a leg portion, a relatively narrow ankle portion, and a relatively broad foot portion. The body is also formed with a notch projecting inwardly from its trailing edge, said notch being located at the juncture of the ankle and foot portions (since the body is pulled along the line of abutment or seam, it has leading and trailing edges);

The leg portion having coupling means at its upper end for connecting it with the adhesive supply squeeze bottle, as aforesaid;

A longitudinal open-ended passageway extending downwardly through the leg and ankle portions to an outlet located at the inner end of the notch, the outlet being positioned to discharge rearwardly;

The foot portion having downwardly and outwardly sloping flat upper surfaces extending laterally from a linear central apex to, in effect, provide a pair of side-by-side wedges having a common flat bottom surface; and The foot portion further forming a longitudinal passageway which is an extension of the leg and ankle passageway, said foot passageway having a centrally located outlet in the foot portion's bottom surface.

In use, the prior tip involves the following:

The foot portion is inserted beneath the adjacent marginal portions of the two floorcovering layers. The wedges thus underlie the marginal portions and cause their side edges to be raised, tilted, spread apart and positioned in proximity to the sealant outlet and notch area; and The combination of the notch walls and the upraised floorcovering side edges form a narrow chamber or conduit, open at the trailing end and having the adhesive outlet at its leading end—the adhesive is fed into the conduit, to wet the floorcovering side edges.

The prior tip has worked well when used with homogeneous vinyl using solvent-based liquid adhesive but, when applied to carpeting and other resilient flooring, certain problems have become evident. More particularly:

The ankle portion has had to be kept quite narrow (typically 1/16"). If this is not done, the seam will open too much as the tip is moved along it. An excessive amount of adhesive will then readily move down the conduit and into the open seam (this excessive flow is referred to as "flooding"). In the case of carpet, when the upraised marginal portions of the floorcovering drop back down to the sub-floor after the tip has passed, the excess adhesive will get squeezed upwardly and will wick into the pile. The installer can then attempt to clean off the surface adhesive, but this is time-consuming, expensive and rarely complete. The presence of adhesive on top of the seam will result in flattening of the pile fibers with traffic, thereby creating an undesired, hard, lumpy ridge running along the seam. In the case of resilient flooring, excess adhesive will accumulate on top of the finished seam and is wasted and must be removed;

Flooding is also partly a result of having to use low viscosity, solvent-based, liquid adhesive. These adhesives will readily flow down the passageway and through the outlet or orifice into the open seam. It has not been possible to substitute a high viscosity, water-based liquid adhesive (referred to hereinafter as "sealant") for use with the prior tip, as it will not flow at a sufficient rate through the narrow ankle passageway and orifice (which typically has a diameter of about 40/1000"). It would be desirable to use a high viscosity, water-based sealant, because it is less toxic than the solvent-based sealant. However this has been deterred because a passageway of greater cross-section would require a thicker ankle portion, which would result in opening the seam wider, thereby inducing an unacceptable degree of flooding;

In addition, it is desirable, with resilient flooring and carpet, to apply some of the sealant to the undersurface of the marginal portions of the floorcovering, to enhance the strength and durability of the seam. Attempts to accomplish this end with the prior tip, by delivering more sealant, simply result in more excess sealant reaching the top surface of the seam;

Since the sub-floor is normally coated with a tacky adhesive, when the prior tip is pressed down against the sub-floor and pulled along the seam the sub-floor adhesive will drag on the tip and will also ball up beneath it. This commonly causes the installer using the tip to lift it out of contact with the sub-floor during use. Several problems can then result. The floorcovering side edges can be spread too far apart, with the consequence that severe flooding will follow. Furthermore, the installer will have to manually press down the wetted edges as he proceeds. This means that the installer has to hold the bottle and tip with one hand, using that hand to squeeze the bottle, while he uses the other hand to press down the wetted side edges. All of this is tiring over time and requires a significant level of skill on the part of the installer. In addition, when the prior tip is lifted, it has a tendency to skew, with the result that the application of sealant to the two side edges is somewhat uneven and erratic;

As previously stated, it is desirable to apply beads of sealant to the undersurface of the floorcovering, both along the abutment line of the seam and laterally spaced therefrom. In the prior tip there is provided an internal passageway extension having an outlet in the bottom surface of the foot portion. However, it is found that there is insufficient pressure created in the passageway to consistently deliver sealant through this outlet for the purpose of wetting the undersurfaces;

When working with carpet, the pile tends to shield or hide the "work area" (where the outlet is discharging the sealant) from the view of the installer, making it difficult to know how hard to work the squeezing of the supply bottle; and As a final point, the tip and attached bottle are unstable and tend to topple over if left in the seam.

It is therefore applicant's objective to modify the prior tip to overcome these problems and produce a better tip which can be used with floorcoverings such as carpet and resilient flooring and which is adapted to be used with high viscosity, water-based liquid adhesive (sealant).

SUMMARY OF THE INVENTION

The present invention is embodied in two distinct tips, one being suited for use with resilient flooring and the other for use with carpet. However both tips incorporate certain novel features, as described below.

In the essential feature of the invention, a laterally extending barrier or wall is positioned close to and rearwardly of the sealant outlet, so as to restrict or prevent the direct rearward flow of sealant along the longitudinal axis of the open seam. In effect, by providing such a barrier, the single, rearwardly opening outlet of the prior tip has been converted into a pair of side-opening outlets which discharge the sealant laterally from the direction of tip motion and directly at the adjacent vertical side edge of the floorcovering.

As a result of this modification, unrestrained flooding of the open seam has been substantially reduced or eliminated. This has then made it possible to make the ankle portion sufficiently thick (now typically 5/16") so as to accommodate an internal passageway and outlet of sufficient width (typically 200/1000 inches) to enable successful application of water-based sealant.

The tip further incorporate means for engaging the top surfaces of the upraised marginal portions of the floorcovering, most preferably to slightly deflect or bend said upwardly slanted portions toward horizontal, to thereby cooperate with the underlying wedges to bracket and guide the floorcovering marginal portions to bring their side edges into close-fitting engagement with the side surfaces of the ankle portion and thus with the side-opening outlets.

In one embodiment, the deflecting means comprises a pair of wing-like members, one of which projects out laterally from each side surface of the ankle portion. The wing members are positioned above the sealant outlets and extend forwardly and rearwardly therefrom. The wing members further are in spaced, generally parallel relation with the top surfaces of the wedges. Each wing member is adapted, as previously stated, to cooperate with its underlying wedge to bracket the upraised marginal portion of floorcovering and guide it into close-fitting engagement with the adjacent ankle portion side surface.

Alternatively, the tip may simply have a pair of side grooves formed in its body, which grooves function to create the narrow ankle portion. The top wall of the groove ca also function as the deflecting means.

By modifying the tip in this fashion, the following results follow:

The barrier acts to restrict the ready escape of sealant down the open seam, thereby reducing flooding;

The deflecting means and wedges cooperate to bracket the upraised marginal portions of floorcovering and hold the side edges thereof in close-fitting engagement with the sealant outlets in the side surfaces of the ankle portion;

The barrier and the now close-fitting floorcovering side edges combine to restrict sealant flow and thereby create backpressure in the internal passageways of the tip;

The thickness of the ankle portion and the size of the internal passageway and sealant outlet can now be increased;

Viscous sealant (such as water-based sealant) can now be applied uniformly and at a suitable rate to the side edges of the floorcovering layers; and The deflecting means further function, in the case of carpet, to bend the pile of the upraised marginal portions outwardly, so that the work area is now visible to the installer.

In a preferred aspect, the foot portion passageway is formed to provide a pair of outlets spaced to each side of the line of abutment. As a result of the backpressure now obtainable in the passageway system, it is possible to deliver beads of sealant through the foot portion outlets on to the sub-flooring, in spaced parallel relationship with the line of abutment.

In another preferred aspect, the top surface of each wedge is undercut to provide a shallow channel leading out laterally from the sealant outlet. These channels function to bring sealant into wetting contact with the undersurfaces of the upraised portions of the floorcovering, immediately adjacent the line of abutment.

In another preferred aspect, a narrow keel is provided to project downwardly from the bottom surface of the foot portion. The keel may be centrally located and aligned with the seam. Alternatively, a pair of "outrigger" keels may be provided, one to each side of the central axis of the foot portion bottom surface. By this addition, it is now feasible to press the tip down firmly against the sub-flooring while moving it along the seam, without incurring significant drag or balling up of the sub-flooring adhesive. As a result of this modification, the elevation of the tip remains constant when in use and the positioning of the floorcovering side edges is stabilized. The end result is that the sealant can be applied in a more consistent and even manner.

In another preferred aspect, a pair of rearwardly located wiper blades are provided on the carpet tip. These wiper blades are supported by the wing members at their rear or trailing ends. The wiper blades extend downwardly, so as to scrape against the upper margins of the side edges of the carpet. The blades function as wipers, to bias excess sealant downwardly so that it moves to the base of the carpet side edges.

In still another preferred aspect, the wiper blades are mounted to and depend from a crossbar connecting the trailing ends of the wing members. As a result of this construction, the wing members are reinforced and a "window" is defined between the rear ends of the wing members, the ankle portion and the crossbar. This window enables the installer to visually monitor the application of the sealant as he draws the tip along the seam.

When all of the components of the various aspects of the invention are combined, an applicator tip is provided which is characterized by the following advantages:

flooding is reduced;

the floorcovering side edges are now positively guided into comparatively tight engagement with the passageway side-opening outlets;

the combination of the downstream transverse barrier close to the sealant outlet and the tight engagement with the floorcovering side edges contributes to creating backpressure in the passageway system, which enables the parallel beads of sealant to be applied to the sub-flooring, parallel to but outwardly spaced from the line of abutment;

the undercutting of the wedge faces and the provision of the sealant beads as aforesaid provide lines of sealant between the floorcovering undersurface and the sub-flooring, both at the seam and outwardly spaced therefrom on both sides, thereby improving the sturdiness of the seam when compared to that obtained with the prior tip;

by reducing flooding and thereby enabling the ankle portion to be thicker, the tip is now capable of handling viscous sealants, such as water-based sealants;

the tip is now consistently referenced in elevation to the sub-flooring, making it more consistent in quality of performance as well as making it easier to handle;

the applicator tip is now held upright in the seam and remains in this stable position, thus allowing the operator to leave the tip unattended in the seam without it being displaced.

DESCRIPTION OF THE PREFERRED EMBODIMENT

Figure 1:
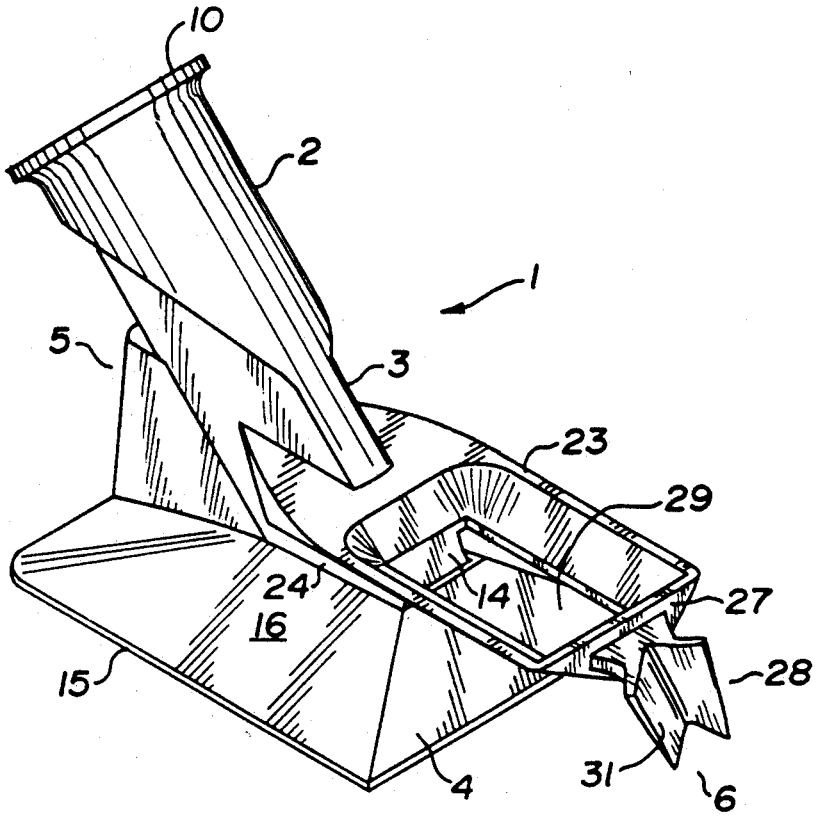
FIG. 1 is a perspective view of a tip for use with carpet.

The applicator tip 1 comprises, from top to bottom, a leg portion 2, ankle portion 3 and foot portion 4. The tip 1 has a front or leading edge 5 and a rear or trailing edge 6 when in use The tip 1 is adapted for seaming adjacent layers 7 of floorcovering. The layers 7 are in linear, side-by-side, abutting relationship along a line of abutment or seam 8. Once formed, a finished seam 9 extends along the line of abutment.

The tip 1 is adapted for use with a plastic squeeze bottle or other container (not shown) containing a supply of liquid adhesive or sealant.

The leg portion 2 forms an internally threaded coupling 10 at its upper end, for connection with the sealant supply bottle. The leg portion 2 further forms a leg passageway extending longitudinally therethrough.

Turning now to the carpet tip of FIGS. 1–7, the ankle portion 3 is generally rectangular in section. It is narrow from its leading edge to its trailing edge, relative to the leg and foot portions 2,4. The ankle portion 3 forms an ankle passageway 12 which extends longitudinally therethrough and communicates at its upper end with the leg passageway 11. The ankle passageway 12 has side-opening outlets 13 at the juncture of the ankle and foot portions 3,4. An upstanding, laterally extending wall 14 forms a transverse barrier for preventing or restricting direct rearward flow of sealant issuing from the outlets 13. Stated otherwise, the wall 14 causes the sealant to discharge laterally.

The foot portion 4 comprises a pair of downwardly and laterally slanting wedges 15. The wedges 15 have top surfaces 16 and a common bottom surface 17. The foot portion 4 forms an internal foot passageway 18 extending longitudinally therethrough. The foot passageway 18 communicates at its upper end with the ankle passageway 12 and has outlets 19 in the bottom surface 17. The central outlet 19 is positioned to coincide with the seam 8. The remaining outlets 19 are laterally spaced on each side of the longitudinal center line of the bottom surface 17. Thus the central outlet 19 may deliver a bead of sealant along the seam 8 and the other outlets 19 deliver beads that are parallel to but laterally spaced from the seam.

A removable bottom plate 20 is attached to the upper wall of the foot portion 4, by screws 21, to provide the bottom surface 17 of said foot portion 4.

Figure 10:
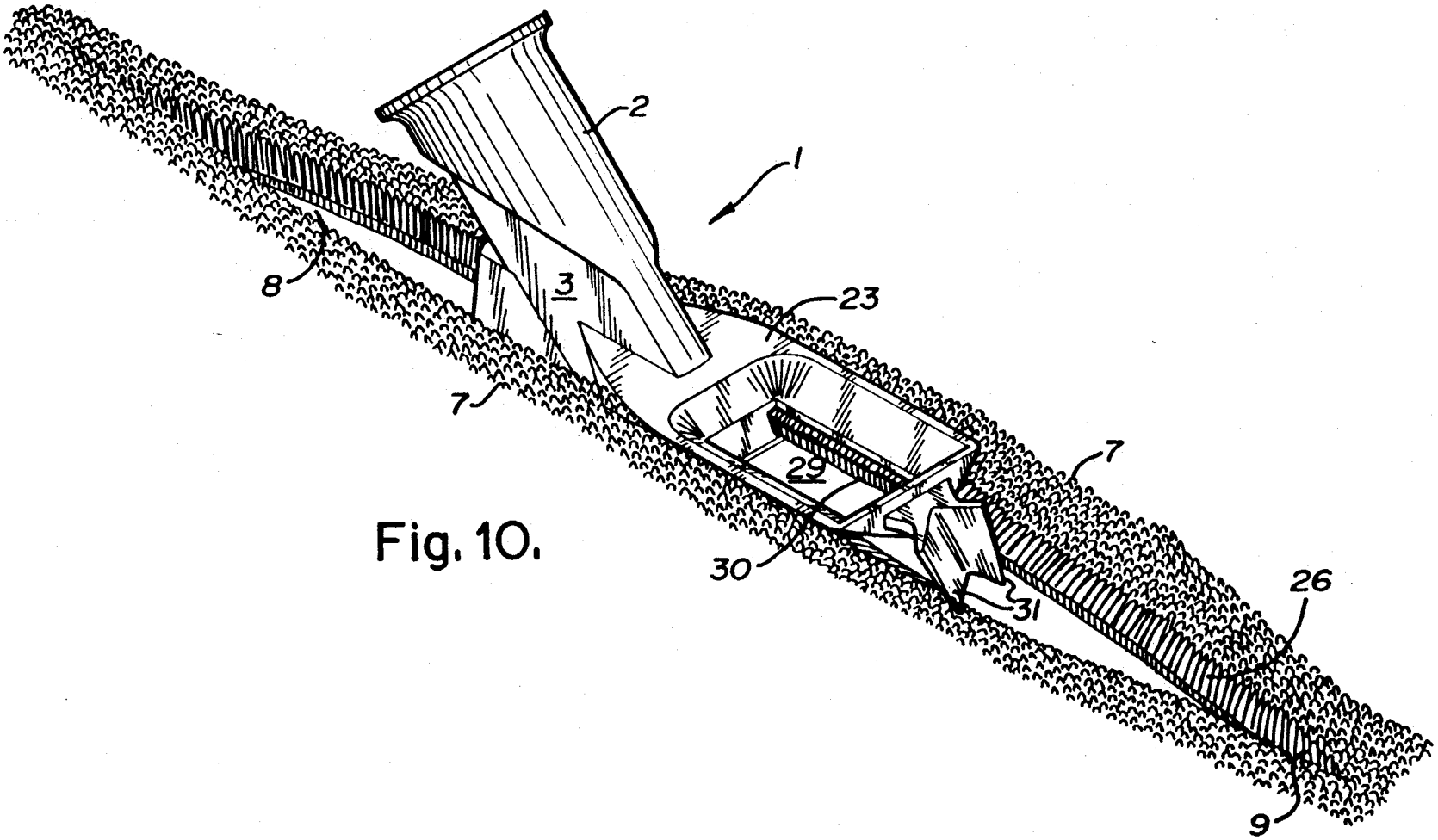
FIG. 10 is a perspective view showing the tip of FIG. 1 in place for seaming between layers of carpet floorcovering.
Figure 11:
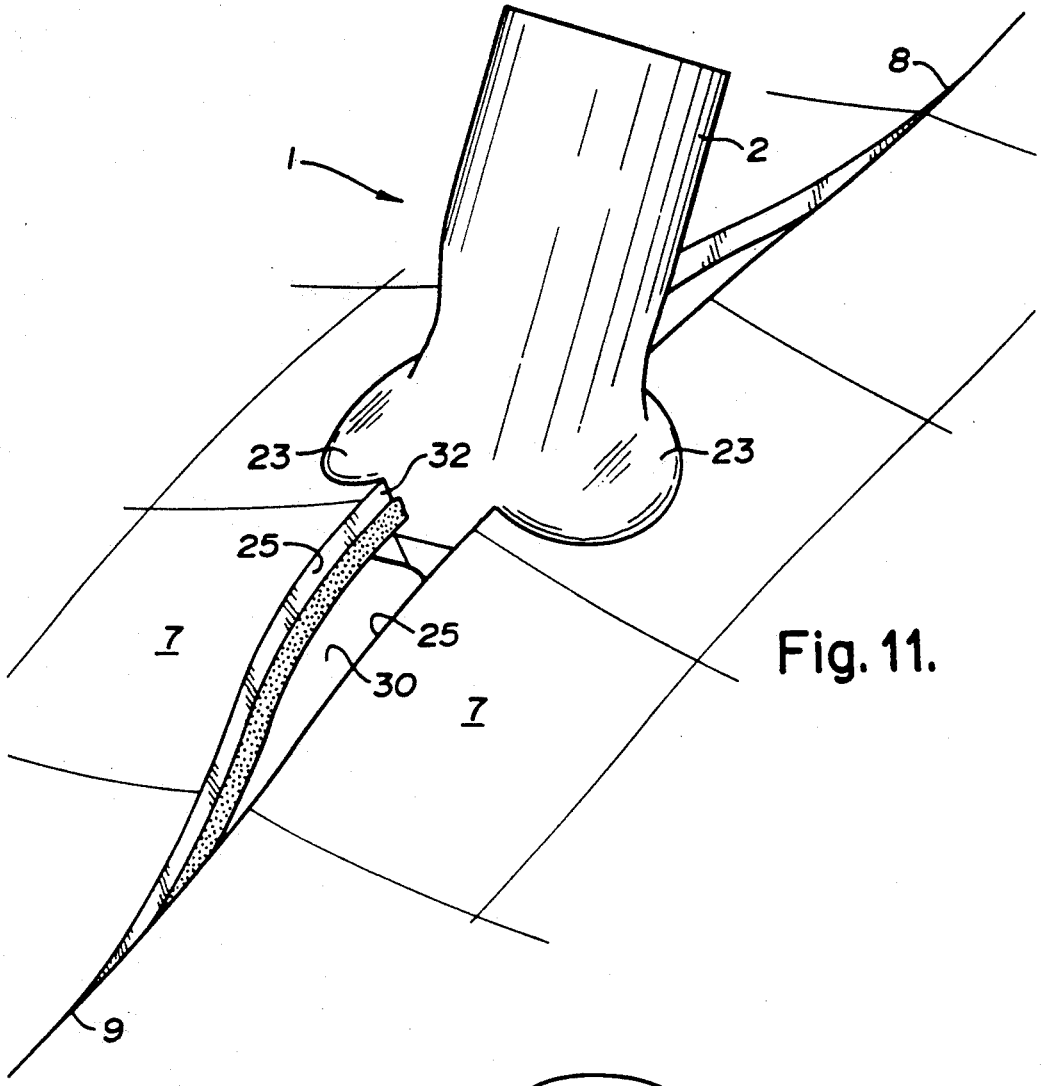
FIG. 11 is a perspective view showing the tip of FIG. 8 in place for seaming between layers of resilient flooring.

A pair of wing members 23 project laterally from the side surfaces 24 of the ankle portion 3. Each wing member 23 is positioned above its adjacent side-opening outlet 13 and extends longitudinally in a generally horizontal plane both forwardly and rearwardly of the outlet. Thus each adjacent associated pair consisting of a wing member 23 and wedge 15 creates means for bracketing and guiding the upraised marginal portion 25 of floorcovering into the desired close-fitting engagement with the ankle portion side surfaces 24. The wing member 23 is also operative to bend the pile 26 outwardly when the tip is being used to seam carpet, as shown in FIG. 10.

At their rear ends, the wing members 23 are connected by a cross-member 27. The cross-member 27 functions both to brace the wing members 23 and to serve as a support for the wiper 28.

The wing members 23 and cross-member 27 combine to form a window 29, to provide visual access to the "work area" or the open seam 30 immediately downstream of the side-opening outlets 13.

The wiper 28 comprises a pair of blades 31 arranged in an upstanding and rearwardly opening V-like configuration. The blades 31 are positioned and adapted to scrape excess sealant from the upstanding side edges 32 of the floorcovering layers 7 and to cause this scraped sealant to move downwardly. Some of the conveyed sealant reaches the undersurface 33 of the floorcovering layer 7, immediately adjacent the seam 8.

Figure 12:
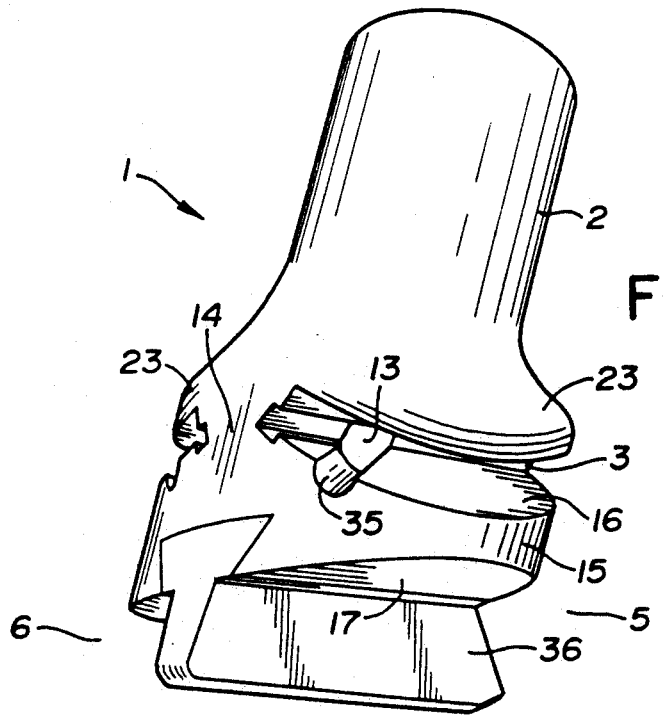
FIG. 12 is a perspective view showing the resilient flooring tip of FIG. 8, said tip having a wedge top surface and adjacent sealant outlet, the surface of the wedge having been grooved to create a shallow channel for sealant flow.

As shown in FIG. 12, each wedge top surface 16 may be recessed to form a shallow channel 35 extending laterally from the adjacent side-opening outlet 13. Sealant can enter this channel 35 to wet the undersurface 33 of the floorcovering at the seam 8.

Turning now to the alternative embodiment shown in FIGS. 8, 9, 11 and 12, a downwardly projecting, narrow keel 36 of small height is provided and extends along the longitudinal center line of the foot portion bottom surface 17. The provision of the keel 36 greatly reduces drag if the tip 1 is pressed down against the adhesive-coated sub-floor 34 and is pulled therealong in steady contact therewith. This provision enables the installer to maintain the tip parts at a consistent elevation, thereby improving the quality of sealant application.

Figures 13, 14:
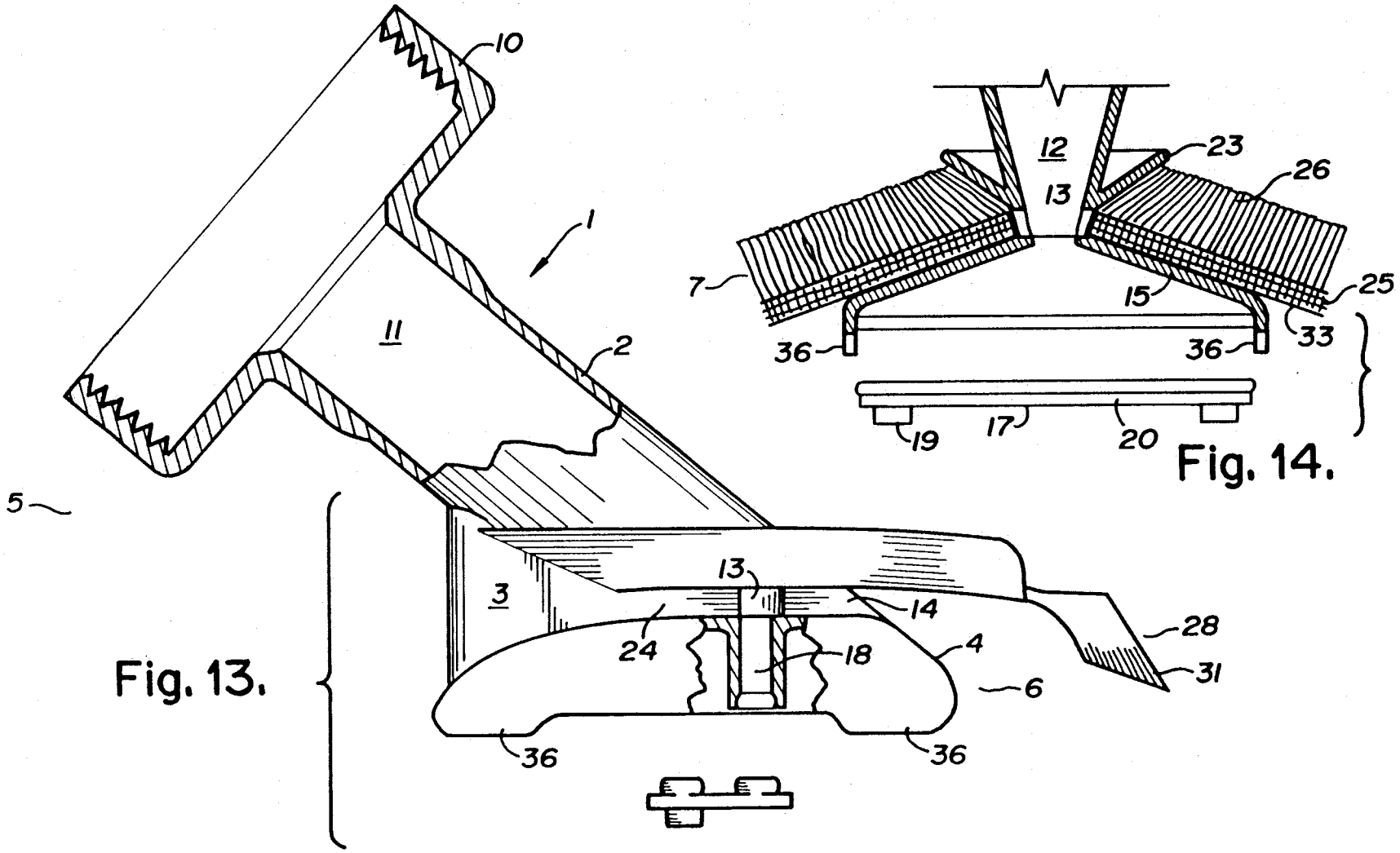
FIG. 13 is a side view of the carpet tip of FIG. 1, but in this case it is equipped with outrigger keels projecting from the base of the foot portion, the passageways being shown in broken lines.
FIG. 14 is a sectional view of part of the tip of FIG. 13, taken along the line A—A and, shown in use.

In the tip version of FIGS. 13 and 14 a pair of shallow outrigger keels 36 project downwardly from the two bottom side edges of the foot portion 4.

Figure 2:
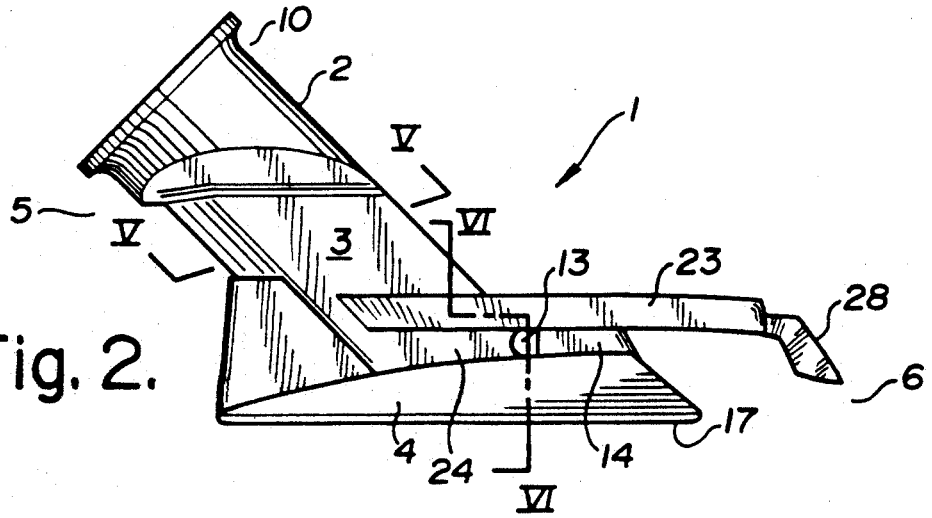
FIG. 2 is a side view of the tip of FIG. 1.
Figure 3:
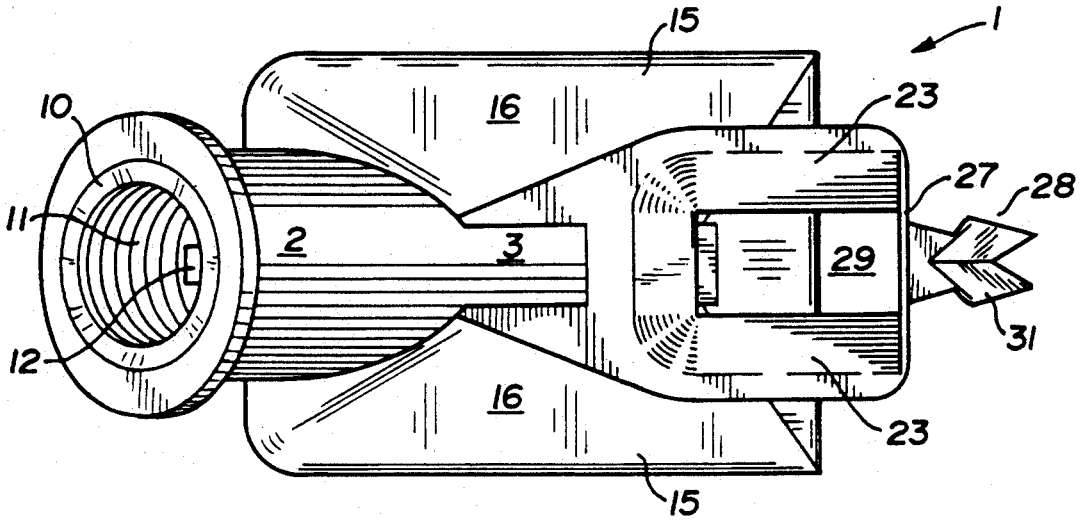
FIG. 3 is a top plan view of the tip of FIG. 1.
Figure 4:
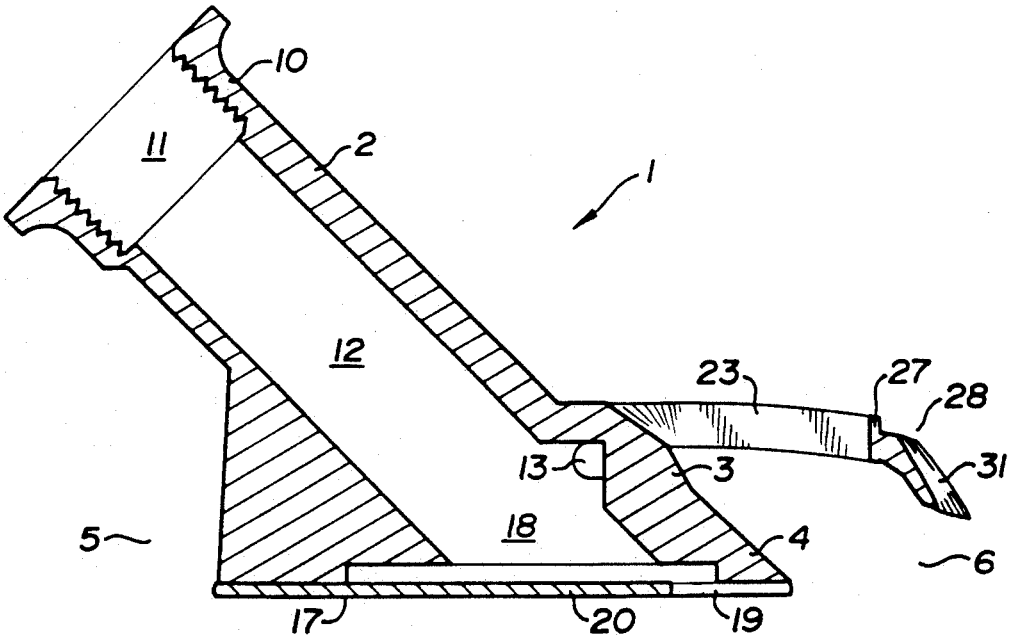
FIG. 4 is a sectional side view of the tip of FIG. 1.
Figure 5:
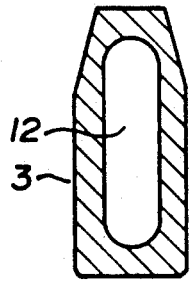
FIG. 5 is a sectional view taken along the line V—V of FIG. 2.
Figure 6:
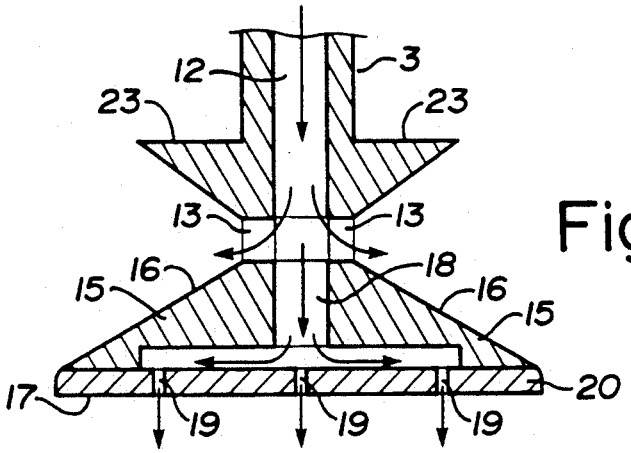
FIG. 6 is a sectional view taken along the line VI—VI of FIG. 2, showing the passageways for sealant flow.
Figure 7:
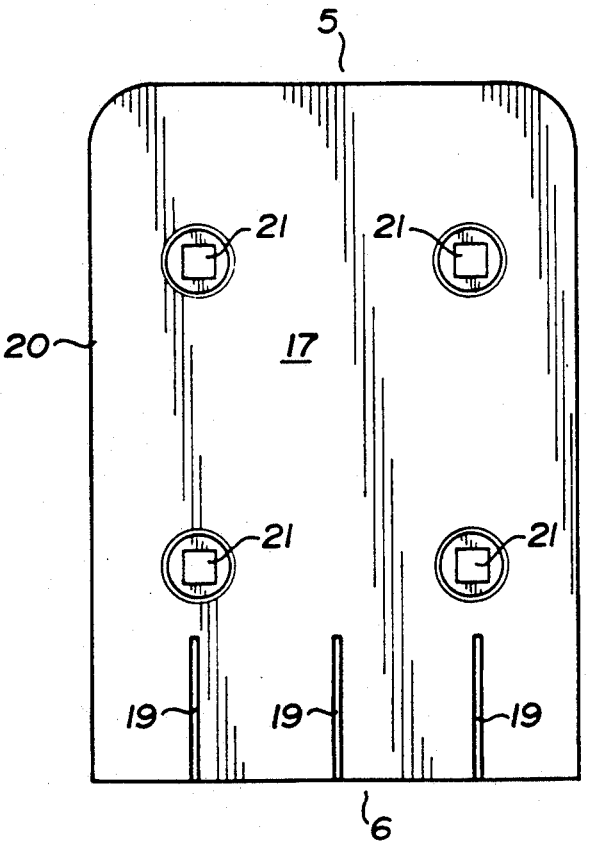
FIG. 7 is a bottom plan view of the foot portion of the tip of FIG. 1.
Figure 8:
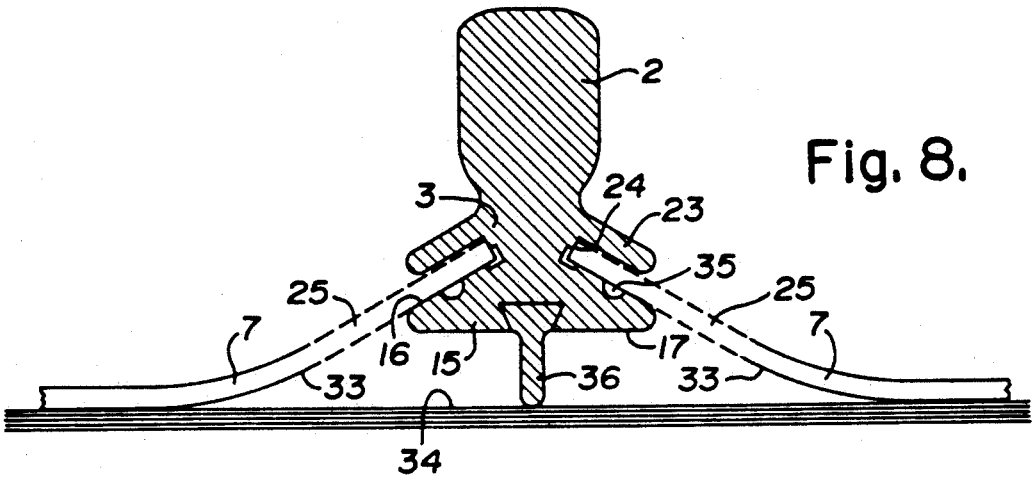
FIG. 8 is a front view of an alternative form of a tip for use with resilient flooring, said tip having a keel and being viewed from the rear, the tip being shown in use.
Figure 9:
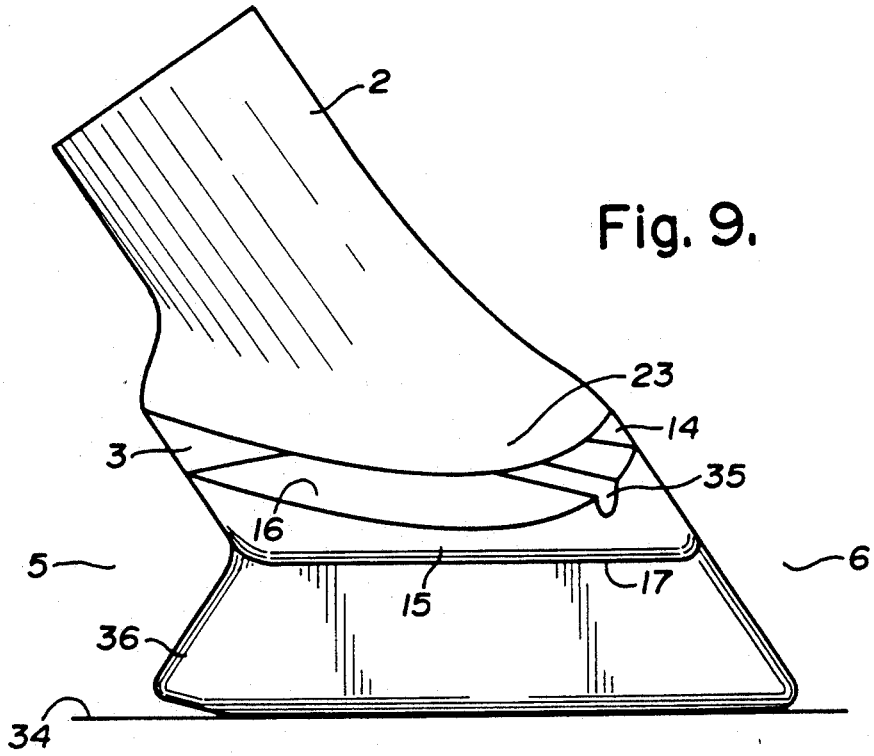
FIG. 9 is a side view of the tip of FIG. 8.
Figure 15A:
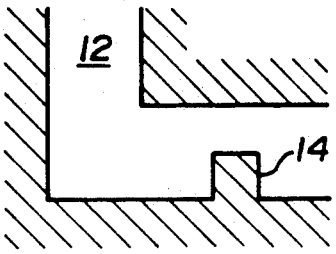
FIGS. 15(*a*), 15(*b*) and 15(*c*) are simplified side views showing three alternative embodiments of barrier walls that can partially restrict rearward flow of sealant.
Figure 15B:
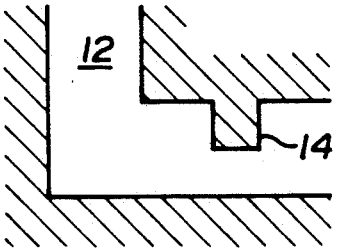
Figure 15C:
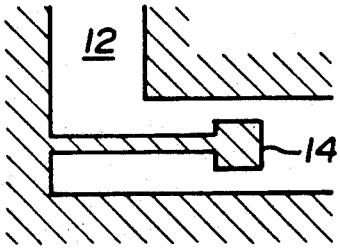

While the preferred form of the barrier is the will 14 of FIG. 2, which joins and is integral with both the ankle and foot portions 3,4, it is contemplated that partial wall members, as shown in FIGS. 15(*a*), 15(*b*) and 15(*c*) could also be used.

In operation, the wedges 15 of the tip 1 are inserted at the seam 8 beneath adjacent marginal portions 25 of the floorcovering layers 7. The wedges 15 function to raise and tilt the marginal portions 25, so that an open seam 30 results. The wing members 23 contact the top surfaces of the upraised marginal portions 25 and bend the floorcovering downwardly a slight amount to bring the side edges 32 into snug engagement with the side surfaces 24 of the ankle portion 3 and with the side-opening outlets 13 formed therein. The sealant flow out of the leg and ankle passageways 11, 12 is thus delivered laterally to the side edges 32. The wall 14 acts as a barrier to reduce the escape of sealant directly downstream into the open seam 30. The close-fitting floorcovering side edges 32 and barrier wall 14 combine to create a closely enclosed chamber or plenum. As a result, manual squeezing of the supply bottle creates backpressure in the passageways 11, 12, 18. Sealant moves into the foot passageway 18 and is extruded through the foot outlets 19 and is delivered as beads to the sub-floor, not only beneath the finish ®d seam 9 but also in spaced parallel alignment on each side thereof. As previously stated, the keel 36 or keels 37 can be used, to enable the installer to press the tip 1 into contact with the sub-floor 34 and maintain a consistent elevation. The wing members 23 bend the pile 26 away and to the side in the region of the seam 8, thereby rendering the area of sealant application visible through the window 29. The wiper blades/ 31 function to scrape excess sealant from the top area of the seam 8 and convey it downwardly between the floor covering side edges 32, while simultaneously pressing down the treated marginal portions 25.

The foregoing description has been directed to the specific best mode embodiment of the tip. The scope of the invention is now defined by the claims following below.

The embodiments of the invention in which an exclusive property or privilege is claimed are defined as follows:

1. An applicator tip for seaming linearly abutting side-by-side layers of floorcovering with liquid sealant to form a seam extending along the line of abutment, comprising:

an upright body having, from top to bottom, a leg portion, a relatively narrow ankle portion and a foot portion, said body having a leading edge and a trailing edge which are aligned with the line of abutment;

said leg portion forming a passageway extending longitudinally therethrough and having means at its upper end for connection with a sealant supply container, whereby sealant may flow downwardly through said leg portion to said ankle portion;

said foot portion having a bottom surface having a longitudinal center line aligned with the seam, said foot portion comprising first means for uplifting and tilting marginal portions of the floorcovering layers, to bring the floorcovering side edges close to the ankle portion side surfaces as the tip is advanced along the seam;

said ankle portion having a longitudinal passageway communicating at its upper end with the leg passageway, said ankle portion forming ankle passageway outlet means for discharging sealant immediately above the central part of said foot portion first means, said body forming a laterally extending barrier immediately to the rear of said outlet means for directing sealant flow laterally as it issues from said outlet means, whereby the sealant is directed toward the adjacent upraised and tilted floorcovering side edge; and said ankle portion further comprising second means, extending out laterally from each side surface of said ankle portion in spaced relation above the sealant outlet and the top surface of said first means, for contacting said uplifted marginal portions to guide their side edges into close-fitting engagement with said ankle portion side surfaces.

2. The applicator tip as set forth in claim 1 wherein:

said first means comprises a pair of side-by-side, outwardly slanting wedges having top surfaces, a central apex positioned to substantially coincide with the line of abutment and a flat common bottom surface.

3. The applicator tip as set forth in claim 2 wherein:

the second means comprises a pair of wing members adapted to extend parallel to the seam along each side of the ankle portion; and comprising wiper blade means for scraping sealant from the upper segments of the floorcovering side edges of the upraised marginal portions and conducting said scraped sealant downwardly, whereby part of it may reach the undersurface of the floorcovering;

a crossbar connecting the rear portions of the wing members;

said wiper blade means depending downwardly from the crossbar.

4. The applicator as set forth in claim 3 wherein:

the wing members and crossbar form an open window extending rearwardly of the ankle portion sealant outlets, whereby the wetted edges are visually observable from above when the applicator tip is in use.

5. The applicator tip as set forth in claim 2 wherein:

the top surface of each wedge is recessed to form a laterally extending, shallow channel extending from the adjacent sealant outlet, whereby sealant entering the channel may contact the undersurface of the upraised marginal portion of the floorcovering.

6. The applicator tip as set forth in claim 5 comprising:

at least one narrow keel projecting downwardly from the bottom surface of the foot portion and being disposed parallel to or coincident with the longitudinal center line of the bottom surface of the foot portion.

7. The applicator tip as set forth in claim 2, comprising:

at least one narrow keel projecting downwardly from the bottom surface of said foot portion and being disposed parallel to or coincident with the longitudinal center line of the bottom surface of said foot portion.

8. The applicator tip as set forth in claim 7 wherein:

the second means comprises a pair of wing members adapted to extend parallel to the seam along each side of the ankle portion; and comprising wiper blade means for scraping sealant from the upper segments of the floorcovering side edges of the upraised marginal portions and conducting said scraped sealant downwardly, whereby part of it may reach the undersurface of the floorcovering;

a crossbar connecting the rear portions of the wing members;

said wiper blade means depending downwardly from the crossbar.

9. The applicator as set forth in claim 8 wherein:

the wing members and crossbar form an open window extending rearwardly of the ankle portion sealant outlets, whereby the wetted edges are visually observable from above when the applicator tip is in use.

10. The applicator tip as set forth in claim 1 wherein:

said foot portion forms a passageway communicating with said ankle passageway, said foot passageway having outlets in the bottom surface of said foot portion, said outlets being spaced laterally on each side of said center line, whereby beads of sealant may be deposited beneath the floorcovering layers and parallel to but laterally spaced from the seam.

11. The applicator tip as set forth in claim 10 wherein:

the second means comprises a pair of wing members adapted to extend parallel to the seam along each side of the ankle portion; and comprising wiper blade means for scraping sealant from the upper segments of the floorcovering side edges of the upraised marginal portions and conducting said scraped sealant downwardly, whereby part of it may reach the undersurface of the floorcovering;

a crossbar connecting the rear portions of the wing members;

said wiper blade means depending downwardly from the crossbar.

12. The applicator as set forth in claim 11 wherein:

the wing members and crossbar form an open window extending rearwardly of the ankle portion sealant outlets, whereby the outlets are visually observable from above when the applicator tip is in use.

13. The applicator tip as set forth in claim 10 comprising:

at least one narrow keel projecting downwardly from the bottom surface of the foot portion and being disposed parallel to or coincident with the longitudinal center line of the bottom surface of the foot portion.

14. The applicator tip as set forth in claim 13 wherein:

the second means comprises a pair of wing members adapted to extend parallel to the seam along each side of the ankle portion; and comprising wiper blade means for scraping sealant from the upper segments of the floorcovering side edges of the upraised marginal portions and conducting said scraped sealant downwardly, whereby part of it may reach the undersurface of the floorcovering;

a crossbar connecting the rear portions of the wing members;

said wiper blade means depending downwardly from the crossbar.

15. The applicator as set forth in claim 14 wherein:

the wing members and crossbar form an open window extending rearwardly of the ankle portion sealant outlets, whereby the wetted edges are visually observable from above when the applicator tip is in use.

16. The applicator tip as set forth in claim 1 comprising:

at least one narrow keel projecting downwardly from the bottom surface of said foot portion and being disposed parallel to or coincident with the longitudinal center line of the bottom surface of said foot portion.

* * * * *